US009216593B2

(12) United States Patent
Kitada et al.

(10) Patent No.: US 9,216,593 B2
(45) Date of Patent: Dec. 22, 2015

(54) INK JET PRINTER AND CONTROL METHOD THEREOF

(71) Applicant: Seiko Epson Corporation, Tokyo (JP)

(72) Inventors: Kenji Kitada, Matsumoto (JP); Takuya Miyakawa, Matsumoto (JP); Takashi Saiba, Shiojiri (JP); Kiyofumi Kitawada, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/674,295

(22) Filed: Mar. 31, 2015

(65) Prior Publication Data

US 2015/0273873 A1 Oct. 1, 2015

(30) Foreign Application Priority Data

Apr. 1, 2014 (JP) ..... 2014-075792

(51) Int. Cl.
*B41J 29/393* (2006.01)
*B41J 11/00* (2006.01)

(52) U.S. Cl.
CPC ..... *B41J 11/002* (2013.01)

(58) Field of Classification Search
CPC ..... B41J 11/0095; B41J 13/0027; B41J 2002/17569; B41J 11/42; B41J 13/103; B41J 13/106
See application file for complete search history.

(56) References Cited

U.S. PATENT DOCUMENTS 7,950,796 B2 * 5/2011 Oyanagi et al. ..... 347/102
8,287,116 B2 * 10/2012 Cofler ..... 347/102
8,617,667 B2 * 12/2013 Kovacs et al. ..... 427/558

FOREIGN PATENT DOCUMENTS

JP 2010-197546 A 9/2010
JP 2012-179747 A 9/2012
JP 2012-179748 A 9/2012

* cited by examiner

*Primary Examiner* — Lamson Nguyen
(74) *Attorney, Agent, or Firm* — Harness, Dickey & Pierce, P.L.C.

(57) ABSTRACT

An ink jet printer includes a transportation mechanism that transports a medium in a first direction; a plasma irradiation mechanism that irradiates the medium with plasma; a head mechanism that ejects ink to a portion of the medium irradiated with the plasma and moves in a second direction intersecting the first direction; and a control section that controls whether to irradiate the medium with the plasma by the plasma irradiation mechanism, wherein the control section prohibits the irradiation of the medium with the plasma when a transportation speed of the medium is in a range of 0 m/min to 0.1 m/min, and irradiates the medium with the plasma when the transportation speed of the medium is greater than 0.1 m/min.

9 Claims, 7 Drawing Sheets

INK JET PRINTER AND CONTROL METHOD THEREOF

BACKGROUND

1. Technical Field

The present invention relates to an ink jet printer and a control method thereof.

2. Related Art

In the related art, a printing method using an ink jet printer is performed by causing small ink droplets to fly and become attached to a medium such as paper. According to the innovative progress of the ink jet printing technology, printing is performed by an ink jet printer on cloth to which ink is highly absorbable such as silk, polyester, or cotton, or on a plastic medium to which ink is not absorbable.

There has been known a technique in which when printing is performed on the plastic medium by the ink jet printer, the surface of the medium is reformed by irradiating the surface with plasma, and the compatibility between the medium and the ink is enhanced (for example, see JP-A-2010-197546, JP-A-2012-179748, and JP-A-2012-179747).

JP-A-2010-197546 discloses an ink jet printer including a line-type head in which the head does not move in a width direction of a medium, and a plasma irradiation mechanism. In addition, JP-A-2012-179748 and JP-A-2012-179747 disclose an ink jet printer that includes a serial-type head in which the head moves in a width direction of a medium and a plasma irradiation mechanism.

As in JP-A-2010-197546, in line printing in which the speed of transporting a medium is constant, even surface modification is easily performed by irradiating the surface with the plasma. However, as in JP-A-2012-179748 and JP-A-2012-179747, since, in serial printing in which the medium intermittently stops, the irradiation time of the plasma when the media is transported is different from that when the media is stopped, it is difficult to perform even surface modification. If the surface modification is not evenly performed, the unevenness may occur according to the attachment of the ink.

SUMMARY

An advantage of some aspects of the invention is to provide an ink jet printer and a control method thereof that can decrease the attachment unevenness of ink when surface modification by plasma irradiation was performed in serial printing.

According to an aspect of the invention, there is provided an ink jet printer, including a transportation mechanism that transports a medium in a first direction; a plasma irradiation mechanism that irradiates the medium with plasma; a head mechanism that ejects ink to a portion of the medium irradiated with the plasma and moves in a second direction intersecting the first direction; and a control section that controls whether to irradiate the medium with the plasma by the plasma irradiation mechanism.

The control section prohibits the irradiation of the medium with the plasma when a transportation speed of the medium is in a range of 0 m/min to 0.1 m/min, and irradiates the medium with the plasma when the transportation speed of the medium is greater than 0.1 m/min.

The ink jet printer may further include a shutter that can open or close a plasma irradiation opening of the plasma irradiation mechanism. The control section may control the shutter so that the plasma irradiation opening is closed when the transportation speed of the medium is in a range of 0 m/min to 0.1 m/min, and may control the shutter so that the plasma irradiation opening is opened when the transportation speed of the medium is greater than 0.1 m/min.

In the ink jet printer, gas for generating plasma is supplied to the plasma irradiation mechanism, and the ink jet printer preferably further includes a gas emission mechanism that emits the gas from the plasma irradiation mechanism when the plasma irradiation opening is closed by the shutter.

The ink jet printer may further include a power supply section that supplies electric power to the plasma irradiation mechanism. The control section may control the power supply section so that supplying the electric power to the plasma irradiation mechanism is stopped when the transportation speed of the medium is in a range of 0 m/min to 0.1 m/min, and may control the power supply section so that the electric power is supplied to the plasma irradiation mechanism when the transportation speed of the medium is greater than 0.1 m/min.

The ink jet printer may include a gas supply mechanism that supplies gas for generating the plasma to the plasma irradiation mechanism; and a gas emission mechanism that emits the gas from the plasma irradiation mechanism. The control section may control the gas emission mechanism so that the gas is emitted from the plasma irradiation mechanism when the transportation speed of the medium is in the range of 0 m/min to 0.1 m/min, and may control the gas supply mechanism so that the gas is supplied to the plasma irradiation mechanism when the transportation speed of the medium is greater than 0.1 m/min.

In the ink jet printer, the plasma irradiation mechanism emits plasma generated in an electricity discharge portion from a plasma irradiation opening, and the electricity discharge portion of the plasma irradiation mechanism is preferably disposed so as not come into contact with the medium.

In the ink jet printer, a distance between the plasma irradiation mechanism and the head mechanism is preferably set so that a time after a predetermined position of the medium is irradiated with the plasma by the plasma irradiation mechanism and before the ejection of the ink to the predetermined position is started by the head mechanism is 240 seconds or less.

In the ink jet printer, the plasma irradiation mechanism is preferably disposed on the head mechanism forwardly in the first direction.

According to another aspect of the invention, there is provided a control method of an ink jet printer that includes a transportation mechanism that transports a medium in a first direction, a plasma irradiation mechanism that irradiates the medium with plasma, and a head mechanism that ejects ink to a portion of the medium irradiated with the plasma and moves in a second direction intersecting the first direction.

The method includes prohibiting the irradiation of the medium with the plasma when a transportation speed of the medium is in a range of 0 m/min to 0.1 m/min, and irradiating the medium with the plasma when the transportation speed of the medium is greater than 0.1 m/min.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
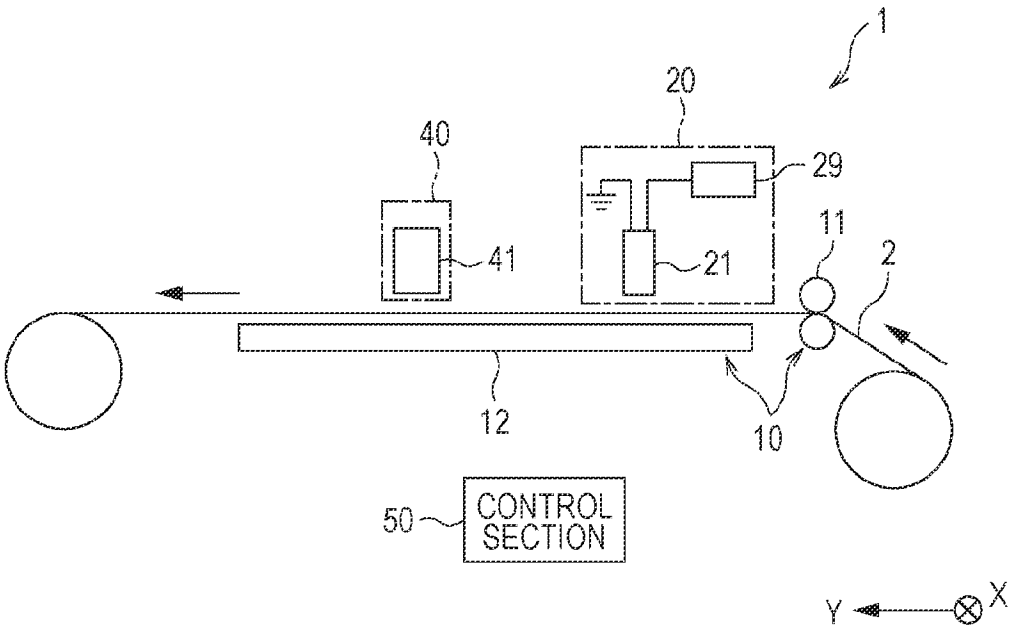
FIG. 1 is a diagram schematically illustrating an ink jet printer according to an embodiment.

Hereinafter, embodiments according to the invention are described in detail. In addition, the invention is not limited to the embodiments described below, and can be modified in various ways without departing from the gist of the invention. In the description below and in the drawings, the transportation direction of a medium is a Y direction, and the width direction of the medium is an X direction.

Ink Jet Printer

FIG. 1 is a diagram schematically illustrating an ink jet printer according to the embodiment. An ink jet printer 1 includes a transportation mechanism 10 that transports a medium 2 in the Y direction (first direction), a plasma treatment device 20 that includes an irradiation mechanism 21 that performs plasma irradiation, a head (head mechanism) 40 that performs printing while moving in the X direction (second direction) intersecting the Y direction, and a control section 50 that controls overall operations of the ink jet printer.

For example, the transportation mechanism 10 includes rollers 11 and a platen 12. In addition, the positions and the number of the rollers 11 are not limited. The platen 12 supports the medium 2 on the side opposite to the surface on which an image is printed on the medium 2. The platen 12 may include a heater therein.

The plasma treatment device 20 includes the plasma irradiation mechanism 21 that emits the plasma generated by an electricity discharge portion from the plasma irradiation opening and irradiates at least a portion of the medium with the plasma and a gas supply source 29 that stores gas to be supplied to the plasma irradiation mechanism 21.

The plasma irradiation mechanism 21 is installed in a head 40 on the upper stream side of the medium in the transportation direction (arrow direction of FIG. 1), that is, on a −Y direction side of the head 40. Each plasma irradiation mechanism 21 is a line-type plasma irradiation mechanism that includes a plasma irradiation opening, for example, extending in the X direction. The plasma irradiation mechanism is classified into spot-type plasma irradiation mechanisms (also referred to as jet-type plasma irradiation mechanisms) and line-type plasma irradiation mechanisms depending on the shape of the plasma irradiation opening. According to the embodiment, if the line-type plasma irradiation mechanism 21 having the plasma irradiation opening extending in the X direction is used, the plasma irradiation amount to the medium 2 in the X direction can be caused to be even. Meanwhile, the plasma irradiation mechanism 21 may be configured with the plural spot-type (jet-type) plasma irradiation mechanisms arranged in a line in the width direction (X direction) of the medium 2. The spot-type plasma irradiation mechanism has an advantage of having many options of the types of the gas compared with the line-type plasma irradiation mechanism.

The time after a predetermined position of the medium 2 is irradiated with the plasma by the plasma irradiation mechanism 21 before ink starts to be ejected to the predetermined position of the medium 2 by the head 40 becomes 240 seconds or less, the distance between the plasma irradiation mechanism 21 and the head 40 is set. Accordingly, while the effect of surface modification of the medium 2 by the plasma is not disappeared, the ink can be attached to the medium 2 so that the print quality can be enhanced.

The plural plasma irradiation mechanisms 21 may be disposed in the transportation direction of the medium 2. If the plural steps of plasma irradiation mechanisms 21 are disposed, the effect of the surface modification of the medium can be sufficiently obtained.

Figure 3:
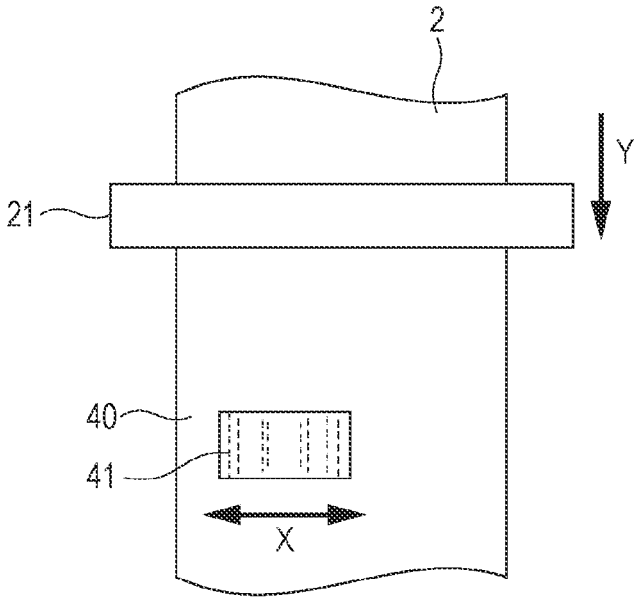
FIG. 3 is a diagram illustrating a printing operation by the ink jet printer according to the embodiment.

The head 40 is a unit that forms an image by attaching droplets of the ink on the surface of the medium 2 irritated with the plasma. The head 40 has plural nozzle arrays configured with plural nozzles 41 that eject ink (FIG. 3). One nozzle array is configured with the plural nozzles that are arranged in a direction (Y direction) intersecting the movement direction (X direction) of a carriage. The plural nozzle arrays are arranged in the movement direction (X direction) of the carriage. For example, the ink in the same composition is ejected from one nozzle array. The nozzles 41 of the head 40 are disposed to face the medium 2. The distance (A) between the medium 2 and the nozzles 41 is not limited, and is, for example, several millimeters.

A method of ejecting the ink from the nozzles 41 of the head 40 is, for example, as follows. Specifically, a method of applying a strong electric field between nozzles and acceleration electrodes positioned on the forward side of the nozzles, continuously ejecting droplet-shaped ink from the nozzles, and applying recording information signals to a deflection electrode while droplets of the ink fly between the deflection electrodes to perform recording, a method of ejecting droplets of the ink without deflection in response to the recording information signals (electrostatic suction type), a method of compulsorily ejecting droplets of the ink by applying pressure to the ink with a small pump and mechanically vibrating the nozzles with an quartz oscillator or the like, a method of ejecting and recording droplets of the ink by simultaneously applying the pressure and recording information signals to the ink with a piezoelectric element (piezo type), a method of ejecting and recording droplets of the ink by heating and foaming the ink with fine electrodes in response to recording information signals (thermal jet type), and the like are included.

The head 40 is a serial-type recording head. The serial-type recording head prints an image by performing scanning (pass) several times in which ink is ejected while the recording head moves in a direction (X direction) intersecting the transportation direction of the medium. In this manner, the ink jet printer according to the embodiment is a so-called serial printer.

The control section 50 is installed at an arbitrary position of the ink jet printer 1, and controls operations of the respective units based on information input from an input unit such as a PC or a touch panel. According to the embodiment, the control section 50 has a function of controlling whether to irradiate the medium 2 with the plasma by the plasma irradiation mechanism 21. That is, the control section 50 controls whether to irradiate the medium 2 with the plasma by the plasma irradiation mechanism 21 in response to the transportation speed of the medium 2. Specifically, the control section 50 controls the plasma irradiation so that the medium 2 is not irradiated with the plasma when the transportation speed of the medium 2 is in the range of 0 m/min to 0.1 m/min, and controls the plasma irradiation so that the medium 2 is irradiated with the plasma when the transportation speed of the medium 2 is greater than 0.1 m/min.

According to the embodiment, the control section 50 controls the plasma irradiation so that the medium 2 is not irradiated with the plasma when the transportation of the medium 2 is stopped or extremely slow, specifically, when the transportation speed is in the range of 0 m/min to 0.1 m/min. Also, the plasma irradiation is controlled so that the medium 2 is irradiated with the plasma when the medium is evaluated to be transported, specifically, when the transportation speed of the medium 2 is greater than 0.1 m/min. In this manner, if the medium 2 is not caused to be irradiated with the plasma by the plasma irradiation mechanism 21 when the transportation of the medium 2 is stopped or extremely slow, the medium 2 can be prevented from being irradiated with excessive plasma when the transportation of the medium 2 is stopped. Accordingly, the irradiation amount of the plasma on the surface of the medium 2 can be caused to be even so that the ink attachment unevenness can be decreased. In this manner, the enhancement of the print quality can be achieved.

Figure 2:
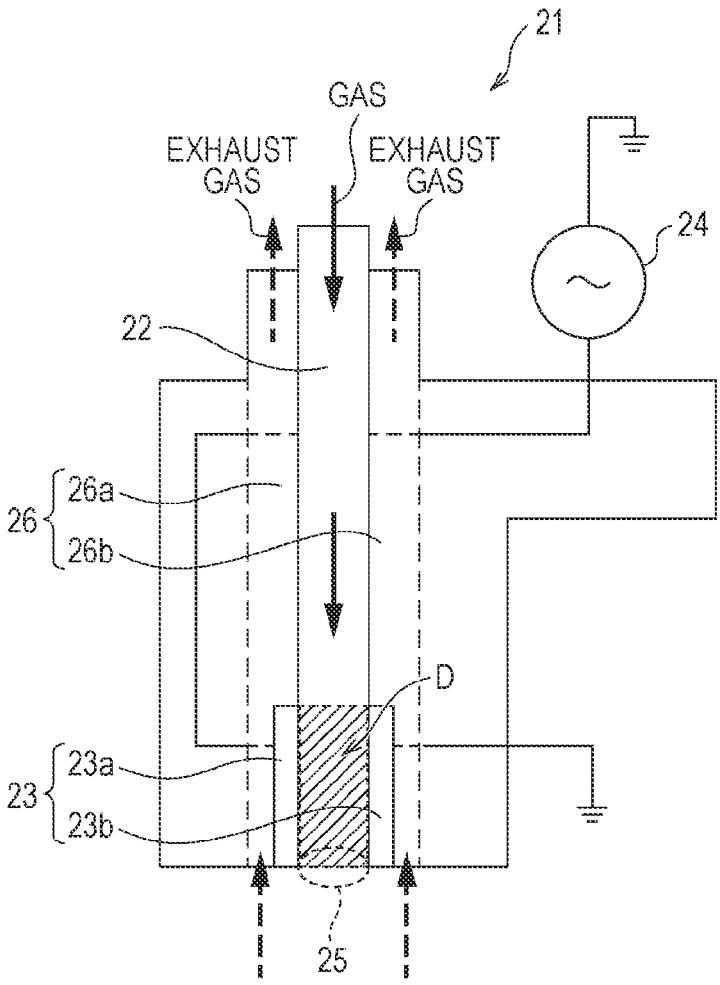
FIG. 2 is a diagram schematically illustrating a cross section of a plasma irradiation mechanism.

FIG. 2 is a diagram schematically illustrating a cross section of the plasma irradiation mechanism 21. The plasma irradiation mechanism 21 includes a gas supplying chamber 22 that is connected to a gas supplying section (not illustrated), an electrode pair 23 that is provided to face at least a portion of the gas supplying chamber 22, a plasma power supply 24, a plasma irradiation opening 25, and exhaust pipes 26.

The gas supplying chamber 22 is connected to a gas supply source 29 (see FIG. 1) by a gas supply tube (not illustrated), so that the gas stored in the gas supply source 29 is in a flowable state. The electrode pair 23 is provided at an arbitrary position of the gas supplying chamber 22. The electrode pair 23 includes electrodes 23*a* and 23*b* installed so as to face each other. The plasma power supply 24 is connected to the electrodes 23*a* and 23*b* so that a voltage can be applied.

The plasma irradiation opening 25 is provided on the front edge of the gas supplying chamber 22 that faces the medium 2. The plasma irradiation opening 25 is a nozzle hole for applying plasma generated by gas passing through a portion between the electrodes 23*a* and 23*b*. The area between the electrodes 23*a* and 23*b* becomes an electricity discharge portion D (discharging area). The plasma irradiation opening 25 is disposed to be close to the surface of the medium 2. The distance between the medium 2 and the plasma irradiation opening 25 is not particularly limited, and is, for example, several millimeters.

The exhaust pipes 26 are installed so as to adjust an irradiation scope of the plasma emitted from the plasma irradiation opening 25 by absorbing and exhausting excess gas and performing plasma irradiation so as to locally treat a desired scope. The installation positions of the exhaust pipes 26 are not particularly limited, but for example, two exhaust pipes 26*a* and 26*b* are included and installed along the gas supplying chamber 22.

If voltage is applied to the electrodes 23*a* and 23*b* by the plasma power supply 24, discharge occurs between the electrodes 23*a* and 23*b* ("the electricity discharge portion D" in FIG. 2). In this manner, in a state in which the discharge occurs, the gas is supplied to the gas supplying chamber 22 and passes through the portion between the electrodes 23*a* and 23*b* so that the plasma of the gas is generated (that is, at least a portion of the gas turns into plasma). The plasma generated in this manner is applied from the plasma irradiation openings 25 to the surface of the medium 2. That is, the plasma generated in electricity discharge portion D is applied to the surface of the medium 2 in a state in which the electricity discharge portion D is not in contact with the medium 2. In other words, since the medium 2 does not pass through the electricity discharge portion D, the medium 2 is not in direct contact with the electricity discharge portion D. Such a plasma generation mechanism is called a remote type as described above.

In this manner, if the remote type plasma irradiation mechanism in which the medium is not in contact with the electricity discharge portion is used, the discoloration of the medium can be suppressed. Therefore, the texture or the tone of the medium is maintained. Particularly, if a medium having high whiteness is used, the effect can be achieved further.

The plasma irradiation mechanism 21 preferably has a mechanism that generates and applies plasma under atmospheric pressure. If the plasma is generated under atmospheric pressure, there is an advantage in that since a pressure reducing mechanism does not have to be provided in the plasma irradiation mechanism, the device can be reduced in size so that the plasma irradiation step is performed in a line (that is, steps such as plasma irradiation step and ink ejection step can be continuously performed). Here, the pressure when the plasma is generated refers to the pressure in the gas supplying chamber 22 when the plasma is generated.

The electric energy of the plasma power supply 24 when the plasma is generated is not particularly limited as long as the plasma can be generated from the supplied gas, but the electric energy can be, for example, in the range of 20 Wh to 200 Wh.

The frequency of the plasma power supply 24 when the plasma is generated is not particularly limited as long as the plasma can be generated from the supplied gas, but the frequency may be, for example, in the range of 50 Hz to 30 MHz. In addition, the plasma power supply 24 may be a direct current power supply. However, since the temperature of the direct current power supply increases more easily, the alternate current power supply is preferably used. In the alternate current power supply, the increase of the temperature can be prevented by switching the current to a current in a reverse direction before the temperature increases.

One kind of gas may be supplied to the gas supplying chamber 22, and a mixed gas obtained by mixing two or more kinds of gas may be supplied. Examples of the material of the gas include oxygen ($O_2$), nitrogen ($N_2$), air (at least including nitrogen ($N_2$) and oxygen ($O_2$)), vapor ($H_2O$), nitrous oxide ($N_2O$), ammonia ($NH_3$), argon (Ar), helium (He), and neon (Ne). In addition, the flow rate of the gas supplied to the gas supplying chamber 22 can be appropriately set according to the capacity of the gas supplying chamber 22, the kind of gas, the kind of medium, and print speed, but the flow rate is not particularly limited.

For example, if oxidizing gas is supplied to the gas supplying chamber 22, a hydroxyl group can be applied to the surface of the medium 2 by the plasma resulting from the oxidizing gas. In addition, if the oxygen atom is included in the structure skeleton of the medium, the plasma resulting from the inert gas can cut the bonding of oxygen included in the medium 2, and thus the hydroxyl group can be generated on the surface of the medium by using inert gas as the gas supplied to the gas supplying chamber 22.

The plasma irradiation mechanism 21 may be a direct type irradiation mechanism, not a remote type irradiation mechanism. The direct type is a type in which the plasma irradiation is performed in a state in which the electricity discharge portion generated between the electrodes is in direct contact with a base material, and the expression "the electricity discharge portion is in direct contact with a base material" means, for example, disposing a work piece (medium in the embodiment) between electrodes to perform a plasma treatment. On the contrary, the remote type is a type in which the treatment is performed by spraying the plasma generated between electrodes to the work piece. In addition, the generation method of the plasma is not limited, and may be glow discharge or corona discharge.

Though not illustrated, a drying mechanism that dries a solvent of the ink may be provided on the backward side of the head 40 in the transportation direction of the medium 2. For example, the drying mechanism may include a heater or a blowing mechanism.

As described below, the kind of the ink is not particularly limited, and various additional mechanisms may be included depending on the kind of ink. For example, if the ink is ultraviolet ray curable ink, an ultraviolet ray irradiation mechanism may be provided on the backward side of the head 40 in the transportation direction of the medium 2. In addition, if the medium 2 is cloth, a mechanism that applies pretreatment liquid for causing ink to be fixed on the cloth may be provided on the forward side of the head 40 in the transportation direction of the medium. In this manner, various additional mechanisms in addition to the carriage can be included depending on the kind of the medium or the ink.

Ink

The composition of the ink is not particularly limited, but additives (components) that are included or that can be included are described below.

The ink may include coloring materials. The coloring materials are selected from pigments and dyes.

Pigment

The light stability of the ink can be enhanced by using a pigment as a coloring material. As a pigment, any one of inorganic pigments and organic pigments can be used.

The inorganic pigment is not particularly limited, but examples thereof include carbon black, iron oxide, titanium oxide, and silicon oxide. The inorganic pigments may be used singly, or two or more types thereof may used in combination.

The organic pigment is not particularly limited, but the examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, and an azo-based pigment. Specific examples of the organic pigment may include the followings.

The pigments used in the black ink are not particularly limited, but examples thereof include carbon black. The carbon black is not particularly limited, and examples thereof include furnace black, lamp black, acetylene black, and channel black (C.I. Pigment Black 7). In addition, commercially available products of the carbon black are not particularly limited, but examples thereof include No. 2300, 900, MCF88, No. 20B, No. 33, No. 40, No. 45, No. 52, MA7, MA8, MA100, and No. 2200B (above are all product names manufactured by Mitsubishi Chemical Corporation), Color black FW1, FW2, FW2V, FW18, FW200, 5150, S160, and 5170, Printex 35, U, V, 140U, Special black 6, 5, 4A, 4, and 250 (above are all product names manufactured by Degussa AG), Conductex SC, Raven 1255, 5750, 5250, 5000, 3500, 1255, and 700 (above are all product names manufactured by Columbian Carbon Japan, Ltd.), Regal 400R, 330R, and 660R, Mogul L, Monarch 700, 800, 880, 900, 1000, 1100, 1300, 1400, and Elftex 12 (above are all product names manufactured by Cabot Corporation).

Examples of the pigments used in a cyan ink include C.I. Pigment Blues 1, 2, 3, 15, 15:1, 15:2, 15:3, 15:4, 15:6, 15:34, 16, 18, 22, 60, 65, and 66, and C.I. Vat Blues 4 and 60. Among them, at least one of C.I. Pigment Blues 15:3 and 15:4 is preferable.

Examples of the pigment used in a magenta ink include C.I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:4, 57, 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violets 19, 23, 32, 33, 36, 38, 43, and 50. Among them, at least one selected from the group consisting of C.I. Pigment Red 122, C.I. Pigment Red 202, and C.I. Pigment Violet 19 is preferable.

Examples of the pigment used in a yellow ink include C.I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among them, at least one selected from the group consisting of C.I. Pigment Yellows 74, 155, and 213 is preferable.

In addition, as the pigments used in respective inks other than the above colors such as green ink or orange ink, well-known pigments in the related art can be used.

Dyes

Dyes may be used as a coloring material. The dyes are not particularly limited, and acid dyes, direct dyes, reactive dyes, and basic dyes can be used.

The content of the coloring material is preferably 0.4% by mass to 12% by mass, and more preferably 2% by mass to 5% by mass with respect to the total mass (100% by mass) of the ink.

Resin

The ink may contain resins. If the ink contains the resins, resin coating is formed on the medium and resultantly the ink is sufficiently fixed to the medium so as to make the friction resistance of the image satisfactory.

The resin may be any one of an anionic resin, a non-ionic resin, or a cationic resin. Among them, since the material is appropriate for the head, the non-ionic resin or the anionic resin is preferable.

The resins may be used singly, or two or more types thereof may be used in combination.

In addition, examples of the resins that may be contained in the ink include a resin dispersant, a resin emulsion, and wax.

Resin Dispersant

When the pigment is contained in the ink according to the embodiment, the ink may contain the resin dispersant so that the pigment is stably dispersed and maintained in water. If the ink contains the pigment dispersed by using the resin dispersant such as the aqueous resin or the water dispersible resin (hereinafter referred to as "resin dispersion pigment"), when the ink is attached to the medium, at least one of the adhesiveness between the medium and the ink or the adhesiveness between solidified products in the ink can be caused to be satisfactory. Among the resin dispersants, since the aqueous resin has excellent dispersion stability, the aqueous resin is preferable.

The resin dispersants may be used singly, or two or more types thereof may be used in combination.

Among the resins, the addition amount of the resin dispersant to the pigment is preferably 1 part by mass to 100 parts by mass and more preferably 5 parts by mass to 50 parts by mass with respect to the 100 parts by mass of the pigment. If the addition amount is in the scope described above, the satisfactory dispersion stability of the pigment in water can be secured.

Resin Emulsion

The ink may contain the resin emulsion. The resin emulsion forms the resin coating to provide an effect of causing the ink to be sufficiently fixed to the medium so that the adhesiveness and the friction resistance of an image can be satisfactory.

In addition, the resin emulsion functioning as a binder is contained in an emulsion state in the ink. If the resin emulsion functioning as a binder is caused to be contained in the ink in an emulsion state, the viscosity of the ink can be easily adjusted to the scope appropriate for the ink jet recording method, and the preservation stability and the ejection stability of the ink become excellent.

The resin emulsions are not particularly limited, but the examples thereof include a homopolymer or a copolymer of (meth)acrylate, (meth)acrylic ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, a fluororesin, and a natural resin. Among them, at least any one of the (meth)acryl-based resin and a styrene-(meth)acrylate copolymer-based resin is preferable, at least one of the acryl-based resin and the styrene-acrylate copolymer-based resin is more preferable, and the styrene-acrylate copolymer-based resin is still more preferable. In addition, the copolymer may be at least one of a random copolymer, a block copolymer, an alternating copolymer, and a graft copolymer.

As the resin emulsion, a commercially available product may be used, or a product manufactured by an emulsion polymerization method as described below may be used. As a method of obtaining thermoplastic resin in the ink in an emulsion state, a method of performing emulsion polymerization on the monomer of the aqueous resin described above in water in the existence of the polymerization catalyst and the emulsifier may be included. The polymerization initiator, the emulsifier, and the molecular weight regulator used in the emulsion polymerization can be used according to the well-known method in the related art.

The average particle diameter of the resin emulsion is preferable in the range of 5 nm to 400 nm, and more preferably in the range of 20 nm to 300 nm in order to cause the preservation stability and the ejection stability of the ink to become further satisfactory.

The average particle diameter in the specification is a volume-based average particle diameter, if not described otherwise. As the measurement method, the light intensity distribution pattern of the diffracted and scattered light is detected by using a laser diffraction particle size distribution measuring device and the light intensity distribution pattern is calculated based on the Mie scattering theory to obtain the volume-based particle size distribution. The volume average particle diameter can be calculated from the particle size distribution. An example of the laser diffraction particle size distribution measuring device may include Microtrac UPA (manufactured by Nikkiso Co., Ltd.).

The resin emulsions may be used singly, or two or more types thereof may be used in combination.

The content of the resin emulsion in the resin is preferably in the range of 0.5% by mass to 7% by mass with respect to the total mass (100% by mass) of the ink. If the content is in the range described above, the solid content concentration can be decreased so that the ejection stability can become further satisfactory.

Surfactant

The ink may contain the surfactant. The surfactant is not particularly limited, but examples thereof may include the acetylene glycol-based surfactant, a fluorine-based surfactant, and a silicone-based surfactant. If the ink contains the surfactants, the preservation stability and the ejection stability of the ink become more satisfactory and also high speed printing become possible.

The acetylene glycol-based surfactant is not particularly limited, but the acetylene glycol-based surfactant is preferably more than one selected from the group consisting of alkylene oxide adducts of 2,4,7,9-tetramethyl-5-decyne-4,7-diol and 2,4,7,9-tetramethyl-5-decyne-4,7-diol, and alkylene oxide adducts of 2,4-dimethyl-5-decyne-4-ol and 2,4-dimethyl-5-decyne-4-ol. Commercially available products of the acetylene glycol-based surfactant are not particularly limited, but examples thereof include Olfine 104 series, E series such as Olfine E1010 (product names manufactured by Air Products Japan, Inc.), and Sufynol 104, 465, and 61 (product names manufactured by Nissin Chemical Industry Co., Ltd.). The acetylene glycol-based surfactants may be used singly, or two or more types thereof may be used in combination.

The fluorine-based surfactant is not particularly limited, but the examples thereof include perfluoroalkyl sulfonic acid salt, perfluoroalkyl carboxylic acid salt, perfluoroalkyl phosphoric acid ester, perfluoroalkyl ethylene oxide adduct, perfluoroalkyl betaine, and a perfluoroalkyl amine oxide compound. Commercially available products of the fluorine-based surfactant are not particularly limited, but the examples thereof include S-144 and S-145 (manufactured by Asahi Glass Co., Ltd.); FC-170C, FC-430, and Fluorad-FC4430 (manufactured by Sumitomo 3M Ltd.); FSO, FSO-100, FSN, FSN-100, and FS-300 (manufactured by DuPont); and FT-250 and 251 (manufactured by Neos Company Limited). The fluorine-based surfactant may be used singly, or two or more types thereof may be used in combination.

As the silicone-based surfactant, a polysiloxane-based compound, a polyether-modified organosiloxane, and the like may be used. The commercially available products of the silicone-based surfactant are not particularly limited, but the specific examples thereof include BYK-306, BYK-307, BYK-333, BYK-341, BYK-345, BYK-346, BYK-347, BYK-348, and BYK-349 (above are product names manufactured by BYK Japan K.K.), and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (above are product names manufactured by Shin-Etsu Chemical Co., Ltd.).

The surfactant may be used singly or two or more types thereof may be used in mixture.

The content of the surfactant is preferably in the range of 0.1% by mass to 3% by mass with respect to the total mass (100% by mass) of the ink since the preservation stability and the ejection stability of the ink become more satisfactory.

Water

The ink may contain water. Particularly, if the corresponding ink is aqueous ink, water is a main medium of the ink, and is the component that is evaporated and scattered when the medium is heated in the ink jet recording.

Examples of the water include pure water such as ion exchanged water, ultrafiltrated water, reverse osmosis water, and distilled water, and water from which ionic impurities are removed as much as possible such as ultrapure water. In addition, if water sterilized by the ultraviolet ray irradiation or the addition of hydrogen peroxide is used, when the pigment dispersing liquid and the ink using the pigment dispersing liquid are preserved for a long time, the generation of the fungus or the bacteria can be prevented.

The content of water is not particularly limited, and may be appropriately determined, if necessary.

Organic Solvent

The ink may contain the volatile water soluble organic solvent. The organic solvent is not particularly limited, but the examples thereof include alcohols or glycols such as glycerine, ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethylmethyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, methanol, ethanol, n-propyl alcohol, iso-propyl alcohol, n-butanol, 2-butanol, tert-butanol, iso-butanol, n-penthanol, 2-penthanol, 3-penthanol, and tert-penthanol, N,N-dimethylformamide, N,N-dimethylacetoamide, 2-pyrrolidone, N-methyl-2-pyrrolidone, 2-oxazolidone, 1,3-dimethyl-2-imidazolidone, dimethyl sulfoxide, sulfolane, and 1,1,3,3-tetramethylurea.

The organic solvent may be used singly, or two or more types thereof may be used in combination. The content of the organic solvent is not particularly limited, and may be appropriately determined, if necessary.

pH Regulator

The ink may contain the pH regulator. Examples of the pH regulator include inorganic alkali such as sodium hydroxide and potassium hydroxide, ammonia, diethanolamine, triethanolamine, triisopropanolamine, morpholine, potassium dihydrogen phosphate, and disodium hydrogen phosphate.

The pH regulator may be used singly, or two or more types thereof may be used in combination. The content of the pH regulator is not particularly limited, and may be appropriately determined, if necessary.

Other Components

In addition to the components described above, various kinds of additives such as a dissolution aid, a viscosity modifier, an antioxidant, a preservative, an anti-fungal agent, an anti-foaming agent, and a corrosion inhibitor may be added to the ink. In addition, if the ink is the ultraviolet ray curable ink, the ink contains, for example, a polymerizable compound and a photo initiator.

Preparation Method of Ink

The ink can be obtained by mixing the components (materials) described above in an arbitrary sequence, filtering the mixture, if necessary, and removing impurities. Here, it is preferable to mix the pigments after being prepared in a state of being evenly dispersed in the solvent in advance, since the handling becomes easy.

As a mixing method of the respective materials, a method of sequentially adding materials to a container including a stirring device such as a mechanical stirrer or a magnetic stirrer and stirring and mixing the materials is preferably used. As the filtration method, for example, the centrifugal filtration or the filter filtration may be used, if necessary.

Medium

Examples of the medium (recording medium) include absorbable and non-absorbable medium. Particularly, the invention can be applied to medium in a wide range of absorption performance from non-absorbable medium to which the penetration of the ink is difficult to absorbable medium to which the penetration of the ink is easy.

The absorbable medium is not particularly limited, but the examples thereof are preferably highly absorbable medium such as cloth. The cloth is not limited to the below, but may include, for example, natural fibers and synthetic fibers such as silk, cotton, wool, nylon, polyester, and rayon.

The non-absorbable medium is not particularly limited, but the examples thereof include plastic films or plates such as polyvinyl chloride, polyethylene, polypropylene, polyethylene terephthalate (PET), metal plates such as iron, silver, copper, and aluminum, metal plates manufactured by depositing the various kinds of metal, plastic films, and alloy plates of stainless steel, brass, or the like. In addition, an ink absorbing layer including silica particles or alumina particles or an ink absorbing layer including the hydrophilic polymer such as polyvinyl alcohol (PVA) or polyvinylpyrrolidone (PVP) is not preferably formed in the non-absorbable medium.

Printing Method

Subsequently, with reference to FIG. 3, the printing method using the ink jet printer 1 (control method of ink jet printer) is described.

As illustrated in FIG. 3, the printing method according to the embodiment is a printing method that performs printing on the medium 2 transported in the Y direction by the transportation mechanism 10, and has a plasma irradiation step of irradiating the medium 2 with plasma by the plasma irradiation mechanism 21 and an ink ejection step of ejecting ink from the head 40 to the portion of the medium 2 to which the plasma is irradiated.

The surface of the medium 2 is reformed by irradiating the medium 2 with the plasma, so that the compatibility of the medium 2 with the ink can be enhanced. The compatibility of the medium 2 with the ink means hydrophilicity or water repellent properties of the medium 2. If the plasma irradiation is performed by the remote type irradiation mechanism, the electricity discharge portion does not come into contact with the medium 2, so that the damage or the discoloration of the medium 2 can be suppressed.

Here, the ink jet printer 1 is a serial-type printer, and the medium 2 is intermittently transported by the transportation mechanism 10. That is, in a state in which the medium 2 is stopped, the printing is performed on the predetermined range of the medium 2 by moving the head 40 in the X direction, and then the medium 2 is moved to a predetermined position in the Y direction by the transportation mechanism 10, and this operation is repeated.

According to the embodiment, when the transportation of the medium 2 is stopped or extremely slow, specifically, when the transportation speed is in the range of 0 m/min to 0.1 m/min, the plasma irradiation is controlled so that the medium 2 is not irradiated with the plasma. Also, when the medium can be evaluated to be transported, specifically, when the transportation speed of the medium 2 is greater than 0.1 m/min, the plasma irradiation is controlled so that the medium 2 is irradiated with the plasma. In this manner, if the medium 2 is not caused to be irradiated with the plasma by the plasma irradiation mechanism 21 when the transportation of the medium 2 is stopped or extremely slow, the medium 2 can be prevented from being irradiated with excessive plasma when the transportation of the medium 2 is stopped. Accordingly, the irradiation amount of the plasma on the surface of the medium 2 can be caused to be even so that the ink attachment unevenness can be decreased. In this manner, the enhancement of the print quality can be achieved.

After the ink ejection, the solvent contained in the ink is dried by the drying mechanism, if necessary. In addition, if the ink is the ultraviolet ray curable ink, ultraviolet ray irradiation is performed after the ejection of the ink.

According to the ink jet printer and the printing method of the embodiment, if the irradiation time of the medium 2 with the plasma is caused to be substantially even in serial printing in which the medium 2 is intermittently transported, the ink attachment unevenness can be decreased, and thus the print quality can be enhanced.

EXAMPLES

As described above, the ink jet printer and the control method according to the embodiment is to control the plasma irradiation so that the medium 2 is not irradiated with the plasma when the transportation speed of the medium 2 is in the range of 0 m/min to 0.1 m/min and to control the plasma irradiation so that the medium 2 is irradiated with the plasma when the transportation speed of the medium 2 is greater than 0.1 m/min. Hereinafter, examples for performing such controls are described in detail, but the invention is not limited to the examples.

Ink Jet Printer 1A

Figure 4:
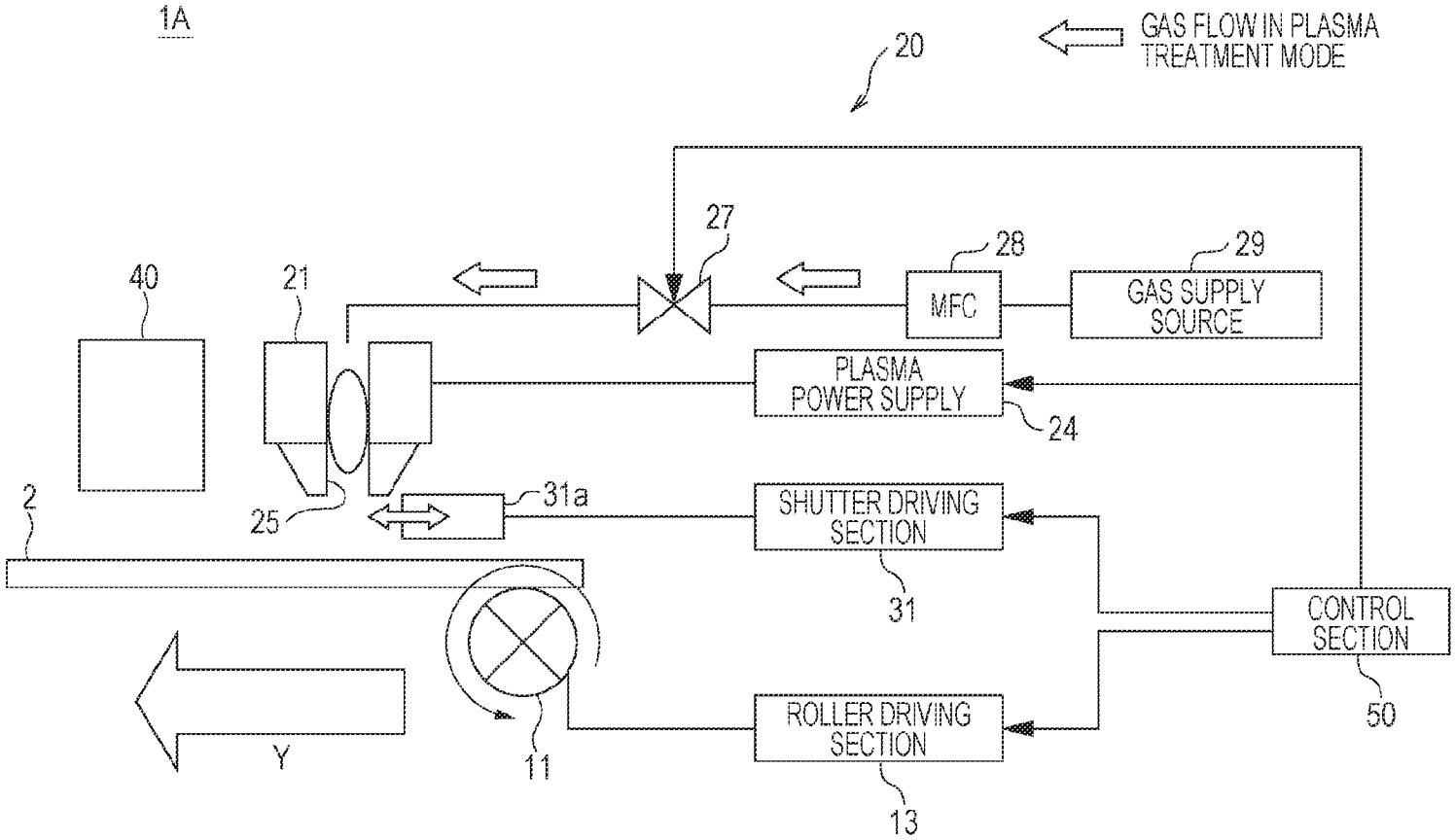
FIG. 4 is a diagram schematically illustrating an example of a configuration of a plasma treatment device in an ink jet printer according to an example.

FIG. 4 is a diagram schematically illustrating a configuration of a plasma treatment device in an ink jet printer 1A according to the example. In FIG. 4 and the description thereof, the same configurations as in the embodiments described above with reference to FIGS. 1 to 3 are denoted by the same reference numerals as in FIGS. 1 to 3, and the detailed descriptions thereof are partially omitted.

As illustrated in FIG. 4, the plasma treatment device 20 in the ink jet printer 1A includes the gas supply source 29 that supplies gas for generating plasma to the plasma irradiation mechanism 21, a mass flow controller (MFC) 28 that prepares the supply amount of the gas from the gas supply source 29, a valve 27 that can stop gas supply from the mass flow controller 28, the plasma power supply 24 (power supply section) connected to the electrode pair 23 of the plasma irradiation mechanism 21, a shutter 31*a* that can open and close the plasma irradiation opening 25, and a shutter driving section 31 that drives the shutter 31*a*. The control section 50 controls various operations of the apparatus, and controls, for example, opening and closing operations of the valve 27, on/off states of the plasma power supply 24, opening and closing operations of the shutter 31*a* by the shutter driving section 31, and the rotation speed of the rollers 11 by a roller driving section 13. The shutter 31*a* is provided between the plasma irradiation opening 25 and the medium 2. As indicated by bidirectional arrows in FIG. 4, the shutter 31*a* moves in the ±Y direction to open and close the plasma irradiation opening 25.

In response to the transportation speed of the medium 2, the control section 50 has two control modes: a plasma treatment mode and a plasma treatment stop mode. Table 1 presents operations of controlling medium transportation, the shutter 31*a*, the valve 27, and the plasma power supply 24 by the control section 50, in the plasma treatment mode and the plasma treatment stop mode.

TABLE 1

| | Media transportation | Shutter | Valve 27 | Plasma power supply |
|---|---|---|---|---|
| Plasma treatment mode | Transportation | Open | Open | On |
| Plasma treatment stop mode | Stop/ Transportation | Close | Close | Off |

As presented in Table 1, if the transportation speed of the medium 2 is greater than 0.1 m/min, the mode becomes the plasma treatment mode so that the control section 50 opens the shutter 31*a*, opens the valve 27, and turns on the plasma power supply 24. Accordingly, the medium 2 is irradiated with the plasma by the plasma irradiation mechanism 21. That is, in the plasma treatment mode, the gas is supplied from the gas supply source 29 to the plasma irradiation mechanism 21. Also, the plasma is generated by the plasma irradiation mechanism 21. Further, since the shutter 31*a* is opened, the plasma is emitted from the plasma irradiation opening 25, and the medium 2 is irradiated with the plasma.

In addition, when the transportation speed of the medium 2 is in the range of 0 m/min to 0.1 m/min, the mode is switched to the plasma treatment stop mode, the control section 50 closes the shutter 31*a*, closes the valve 27, and turns off the plasma power supply 24. Accordingly, the plasma is not generated by the plasma irradiation mechanism 21, and the medium 2 is not irradiated with the plasma. That is, in the plasma treatment stop mode, the shutter 31*a* is closed, and the gas is not supplied from the gas supply source 29 to the plasma irradiation mechanism 21. Accordingly, the plasma is not generated by the plasma irradiation mechanism 21, and the medium 2 is not irradiated with the plasma.

The determination on whether the transportation speed of the medium 2 is in the range of 0 m/min to 0.1 m/min or whether the transportation speed is greater than 0.1 m/min can be performed without providing a speed sensor, since there is a correlation between the control of the roller driving section 13 by the control section 50 and the transportation speed of the medium 2. However, a speed sensor that detects the speed of the medium 2 may be provided and the transportation speed of the medium 2 may be determined based on the speed detected by the speed sensor.

In this manner, in the ink jet printer 1A, the control section 50 controls the shutter driving section 31 so that the shutter 31*a* closes the plasma irradiation opening 25 when the transportation speed of the medium 2 is in the range of 0 m/min to 0.1 m/min, and controls the shutter driving section 31 so that the shutter 31*a* opens the plasma irradiation opening 25 when the transportation speed of the medium 2 is greater than 0.1 m/min. Accordingly, according to the opening and the closing of the shutter, the on/off states of the plasma irradiation can be easily controlled.

In addition, in the ink jet printer 1A, when the transportation speed of the medium 2 is in the range of 0 m/min to 0.1 m/min, the control section 50 turns off the plasma power supply 24 so that the supply of the electric power to the plasma irradiation mechanism 21 is stopped, and when the transportation speed of the medium is greater than 0.1 m/min, the control section 50 turns on the plasma power supply 24 so that the electric power is supplied to the plasma irradiation mechanism 21. If the shutter opening and closing operations and the on/off states of the plasma power supply are used in a combined manner, the on/off states of the plasma irradiation can be more effectively controlled. In addition, in the ink jet printer 1A, the control section 50 can suppress the increase of the internal pressure of the gas in the plasma irradiation mechanism 21 by closing the valve 27 when the transportation speed of the medium 2 is in the range of 0 m/min to 0.1 m/min. As a result, it is possible to suppress a large amount of plasma from being emitted instantly when the plasma irradiation mechanism 21 is damaged or the shutter 31*a* is opened.

Ink Jet Printer 1B

Figure 5:
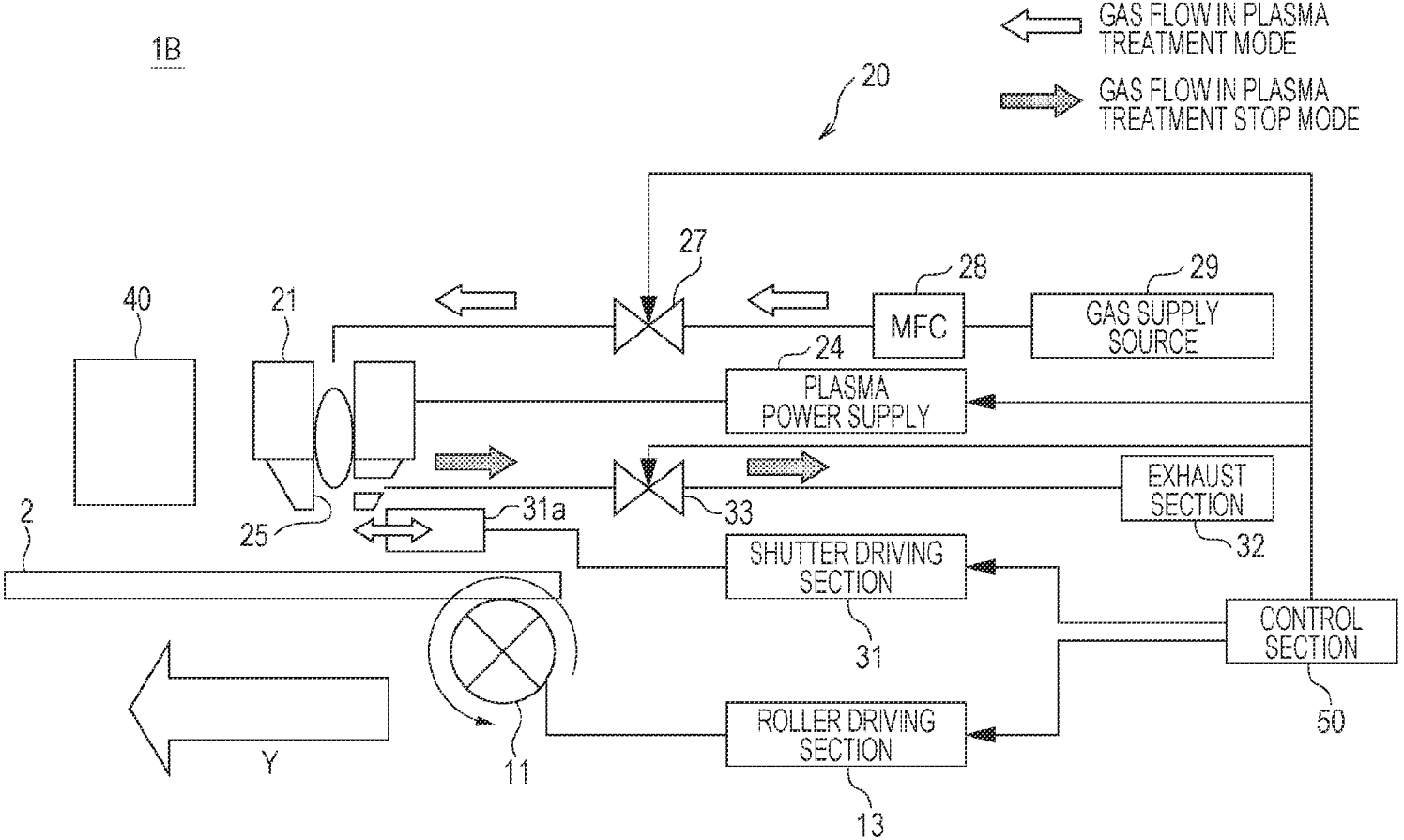
FIG. 5 is a diagram schematically illustrating another example of the configuration of the plasma treatment device in the ink jet printer according to the example.

FIG. 5 is a diagram schematically illustrating a configuration of the plasma treatment device in the ink jet printer 1B according to the example. The differences from the ink jet printer 1A are mainly described. In FIG. 5 and the description thereof, the same configurations as in the embodiments described above with reference to FIGS. 1 to 3 and the example described above with reference to FIG. 4 are denoted by the same reference numerals as in FIGS. 1 to 4, and the detailed descriptions thereof are partially omitted.

As illustrated in FIG. 5, the plasma treatment device 20 in the ink jet printer 1B includes an exhaust section 32 formed with a pump that emitting the gas from the plasma irradiation mechanism 21 and a valve 33 that controls the on/off states of the exhaust operation by the exhaust section 32, in addition to the configuration of the ink jet printer 1A. The exhaust section 32 and the valve 33 are examples of gas emission mechanisms according to the invention. The control section 50 controls various kinds of operations of the apparatus, and controls the opening and closing operations of the valve 33 in addition to the same controls as in the ink jet printer 1A.

Table 2 presents operations of controlling the medium transportation, the shutter 31*a*, the valve 27, and the plasma power supply 24 by the control section 50, in the plasma treatment mode and the plasma treatment stop mode.

TABLE 2

| | Medium transportation | Shutter | Valve 27 | Valve 33 | Plasma power supply |
|---|---|---|---|---|---|
| Plasma treatment mode | Transportation | Open | Open | Close | On |
| Plasma treatment stop mode | Stop/ Transportation | Close | Open | Open | On |

As presented in Tables 2, when the transportation speed of the medium 2 is greater than 0.1 m/min, the mode becomes the plasma treatment mode, and the control section opens the shutter 31*a*, opens the valve 27, closes the valve 33, and turns on the plasma power supply 24. Accordingly, the medium 2 is irradiated with the plasma by the plasma irradiation mechanism 21. That is, in the plasma treatment mode, the gas is supplied from the gas supply source 29 to the plasma irradiation mechanism 21. Also, the plasma is generated in the plasma irradiation mechanism 21. Further, since the shutter 31*a* is opened, the plasma is emitted from the plasma irradiation opening 25, and the medium 2 is irradiated with the plasma. The operations in the plasma treatment mode are the same as in the ink jet printer 1A.

In addition, when the transportation speed of the medium 2 is in the range of 0 m/min to 0.1 m/min, the mode becomes the plasma treatment stop mode, and the control section 50 closes the shutter 31*a* and opens the valve 33. In Example 2, in the plasma treatment stop mode, while the valve 27 is kept open, the plasma power supply is kept to be turned on. That is, in the plasma treatment stop mode, the gas is supplied from the gas supply source 29 to the plasma irradiation mechanism 21, and the plasma is generated. However, since the shutter 31*a* is closed, the medium 2 is not irradiated with the plasma generated by the plasma irradiation mechanism 21. In addition, in the plasma treatment stop mode, the gas supplied to the plasma irradiation mechanism 21 is sent to the exhaust section 32.

In this manner, in the ink jet printer 1B, when the plasma irradiation opening 25 is closed by the shutter 31*a*, the valve 33 is opened so that the gas is emitted from the plasma irradiation mechanism 21 by the exhaust section 32. Accordingly, it is possible to suppress the increase of the internal pressure of the plasma irradiation mechanism 21 when the shutter 31*a* is closed. As a result, it is possible to suppress a large amount of plasma from being emitted instantly when the plasma is leaked to the outside, the plasma irradiation mechanism 21 is damaged, and the shutter 31*a* is opened. Also, in Example 2, in the plasma treatment stop mode, if the plasma power supply is kept to be turned on, the mode can be switched to the next plasma treatment mode at a high speed.

Ink Jet Printer 1C

Figure 6:
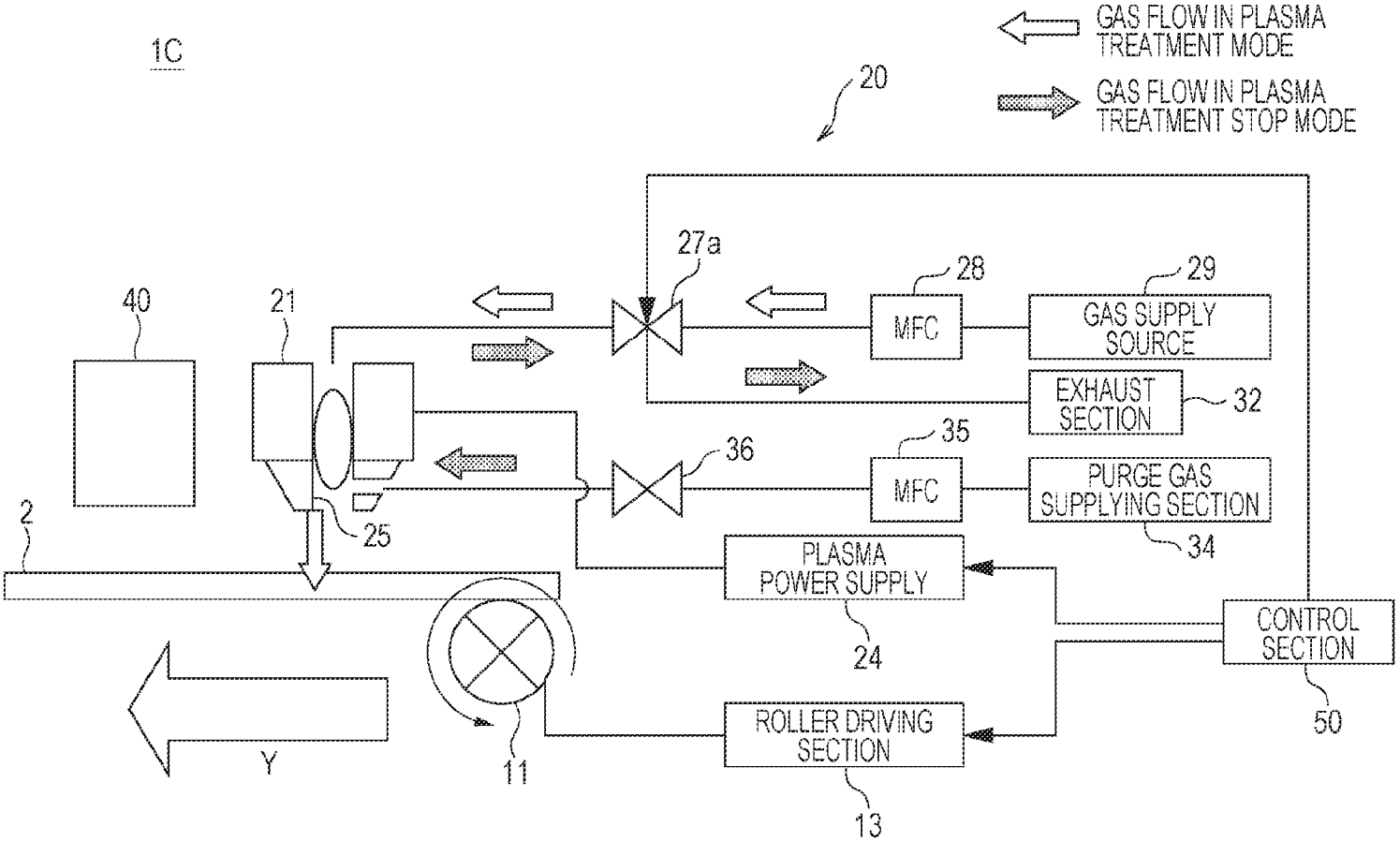
FIG. 6 is a diagram schematically illustrating another example of the configuration of the plasma treatment device in the ink jet printer according to the example.

FIG. 6 is a diagram schematically illustrating a configuration of the plasma treatment device in an ink jet printer 1C according to the example. In FIG. 6 and the description thereof, the same configurations as in the embodiments described above with reference to FIGS. 1 to 3 and the examples described above with reference to FIGS. 4 and 5 are denoted by the same reference numerals as in FIGS. 1 to 5, and the detailed descriptions thereof are partially omitted.

As illustrated in FIG. 6, the plasma treatment device 20 in the ink jet printer 1C includes the gas supply source 29 that supplies gas for generating plasma, the mass flow controller (MFC) 28 that prepares a supply amount of the gas from the gas supply source 29, the exhaust section 32, a three way valve 27*a* that can switch the supply of the gas from the mass flow controller 28 and the exhaustion of the gas by the exhaust section 32, the plasma power supply connected to the electrode pair 23 of the plasma irradiation mechanism 21, a purge gas supply source 34 that supplies purge gas ($N_2$) to the plasma irradiation mechanism 21, a mass flow controller (MFC) 35 that prepares the supply amount of the purge gas from the purge gas supply source 34, and a valve 36 that can block the supply of the gas from the mass flow controller (MFC) 35. The control section 50 controls various operations of the apparatus, and controls, for example, switching operation of the three way valve 27*a*, on/off states of the plasma power supply 24, and the rotation speed of the rollers 11 by the roller driving section 13.

The control section 50 has two control modes: the plasma treatment mode and the plasma treatment stop mode in response to the transportation speed of the medium 2. Table presents operations of controlling the medium transportation, the three way valve 27*a*, the valve 36, and the plasma power supply 24, by the control section 50, in the plasma treatment mode and the plasma treatment stop mode.

TABLE 3

| | Media transportation | Three way valve 27a | Valve 36 | Plasma power supply |
|---|---|---|---|---|
| Plasma treatment mode | Transportation | Gas Supply | Close | On |
| Plasma treatment stop mode | Stop/ Transportation | Exhaust | Open | On |

As illustrated in Table 3, when the transportation speed of the medium 2 is greater than 0.1 m/min, the mode becomes the plasma treatment mode, and the control section 50 controls the three way valve 27*a* so that the gas from the gas supply source 29 is supplied to the plasma irradiation mechanism 21, closes the valve 36, and turns on the plasma power supply 24. Accordingly, the medium 2 is irradiated with the plasma by the plasma irradiation mechanism 21. That is, in the plasma treatment mode, the gas is supplied from the gas supply source 29 to the plasma irradiation mechanism 21. Also, the plasma is generated by the plasma irradiation mechanism 21. The generated plasma is emitted from the plasma irradiation opening 25 so that the medium 2 is irradiated with the plasma.

In addition, when the transportation speed of the medium 2 is in the range of 0 m/min to 0.1 m/min, the mode becomes the plasma treatment stop mode, and the control section 50 controls the three way valve 27*a* so that the gas is exhausted from the plasma irradiation mechanism 21 by the exhaust section 32, and performs control so that the valve is opened, and the purge gas flows from the purge gas supply source 34 to the plasma irradiation mechanism 21. In Example 3, in the plasma treatment stop mode, the plasma power supply is kept to be turned on. That is, in the plasma treatment stop mode, the plasma irradiation mechanism is driven, but the gas is not supplied from the gas supply source 29 to the plasma irradiation mechanism 21, and the plasma is not generated. In addition, in the plasma treatment stop mode, the purge gas is sent from the purge gas supply source 34 to the plasma irradiation mechanism 21, and the purge gas is sent to the exhaust section 32.

In this manner, in the ink jet printer 1C, when the transportation speed of the medium 2 is in the range of 0 m/min to 0.1 m/min, the control section 50 controls the three way valve 27*a* so that the gas is emitted from the plasma irradiation mechanism 21 by the exhaust section 32, and when the transportation speed of the medium is greater than 0.1 m/min, the control section 50 controls the three way valve 27*a* so that the gas is supplied from the gas supply source 29 to the plasma irradiation mechanism 21. Accordingly, the on/off states of the plasma irradiation can be easily controlled by the supply of the gas and the control of the emission.

In other words, in the ink jet printer 1C, in the plasma treatment mode, the gas is controlled to flow toward the plasma irradiation opening 25 of the plasma irradiation mechanism 21, and in the plasma treatment stop mode, the purge gas is controlled to flow to the plasma irradiation mechanism 21 in a direction opposite to the direction in the plasma treatment mode. In this manner, if the flow of the gas is reversed, the on/off states of the plasma irradiation can be easily controlled.

Ink Jet Printer 1D

Figure 7:
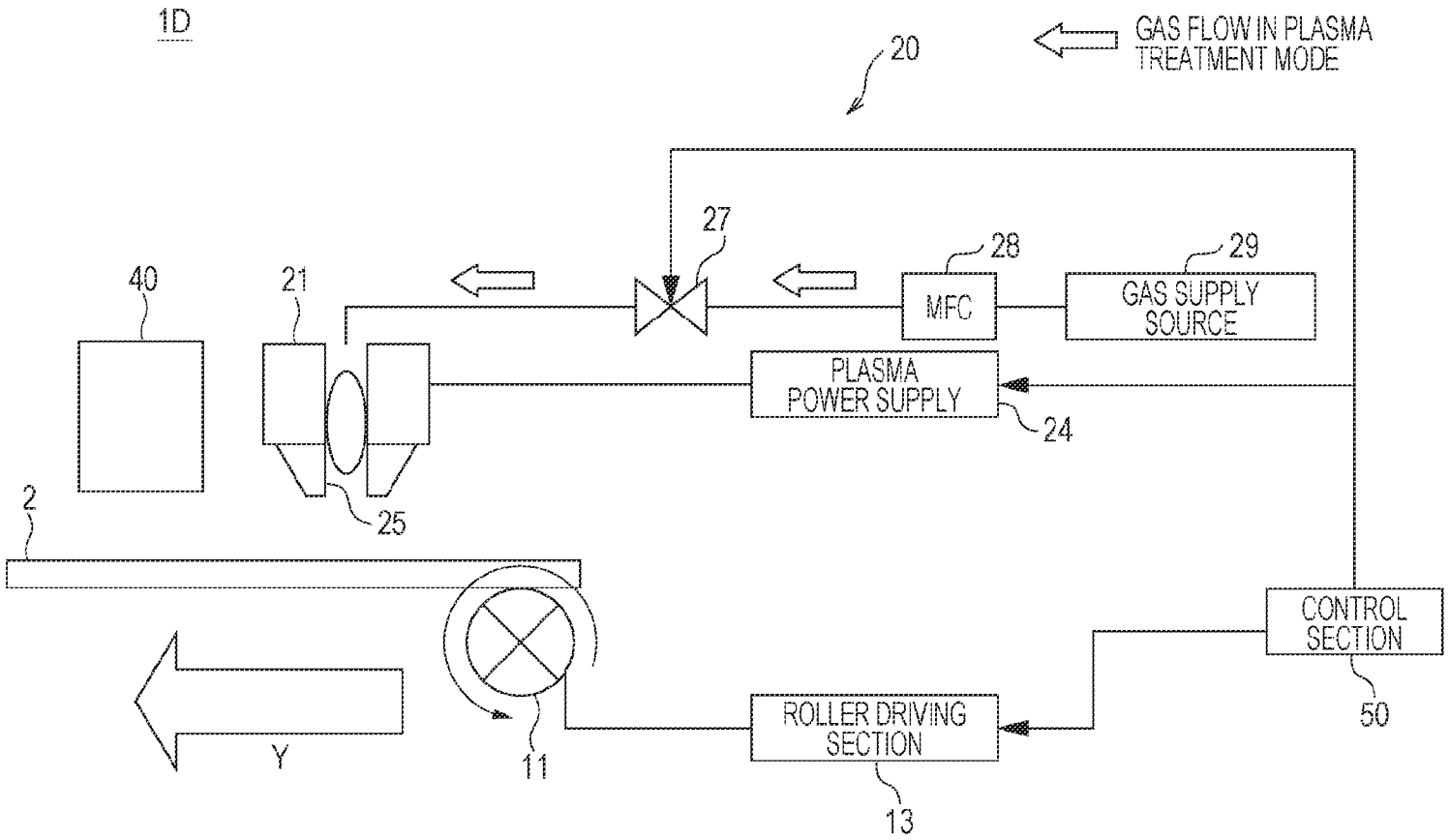
FIG. 7 is a diagram schematically illustrating another example of the configuration of the plasma treatment device in the ink jet printer according to the example.

FIG. 7 is a diagram schematically illustrating a configuration of the plasma treatment device in an ink jet printer 1D according to the example. In FIG. 7 and the description thereof, the same configurations as in the embodiments described above with reference to FIGS. 1 to 3 and the example described above with reference to FIG. 4 are denoted by the same reference numerals as in FIGS. 1 to 4, and the detailed descriptions thereof are partially omitted.

As illustrated in FIG. 7, the plasma treatment device 20 in the ink jet printer 1D includes the gas supply source 29 that supplies gas for generating plasma, the mass flow controller (MFC) 28 that prepares the supply amount of the gas from the gas supply source 29, the valve 27 that can stop the supply of the gas from the mass flow controller 28, and the plasma power supply 24 (power supply section) that is connected to the electrode pair 23 of the plasma irradiation mechanism. The control section 50 controls various operations of the apparatus, and controls, for example, the opening and closing operations of the valve 27, the on/off states of the plasma power supply 24, and the rotation speed of the rollers 11 by the roller driving section 13.

The control section 50 has two control modes: the plasma treatment mode and the plasma treatment stop mode in response to the transportation speed of the medium 2. Table presents operations of controlling the medium transportation, the valve 27, and the plasma power supply 24, by the control section 50, in the plasma treatment mode and the plasma treatment stop mode.

TABLE 4

| | Media transportation | Valve 27 | Plasma power supply |
|---|---|---|---|
| Plasma treatment mode | Transportation | Open | On |
| Plasma treatment stop mode | Stop/Transportation | Close | Off |

As illustrated in Table 4, when the transportation speed of the medium 2 is greater than 0.1 m/min, the mode becomes the plasma treatment mode, and the control section 50 opens valve 27 and turns on the plasma power supply 24. Accordingly, the medium 2 is irradiated with the plasma by the plasma irradiation mechanism 21. That is, in the plasma treatment mode, the gas is supplied from the gas supply source 29 to the plasma irradiation mechanism 21. Also, the plasma is generated by the plasma irradiation mechanism 21. The generated plasma is emitted from the plasma irradiation opening 25 so that the medium 2 is irradiated with the plasma.

In addition, when the transportation speed of the medium 2 is in the range of 0 m/min to 0.1 m/min, the mode becomes the plasma treatment stop mode, the control section 50 closes valve 27 and turns off the plasma power supply 24. Accordingly, the plasma is not generated by the plasma irradiation mechanism 21, and the medium 2 is not irradiated with the plasma. That is, in the plasma treatment stop mode, the gas is not supplied from the gas supply source 29 to the plasma irradiation mechanism 21. Accordingly, the plasma is not generated by the plasma irradiation mechanism 21, and the medium 2 is not irradiated with the plasma.

In this manner, in the ink jet printer 1D, when the transportation speed of the medium 2 is in the range of 0 m/min to 0.1 m/min, the control section 50 turns off the plasma power supply 24 so that the supply of the electric power to the plasma irradiation mechanism 21 is stopped, and when the transportation speed of the medium is greater than 0.1 m/min, the control section 50 turns on the plasma power supply 24 so that the electric power is supplied to the plasma irradiation mechanism 21. In this manner, the on/off states of the plasma irradiation can be easily controlled even if the shutter is not provided.

Evaluation

Printing is performed while the ratio of the types of gas used in the control method and the plasma irradiation method of the ink jet printers 1A to 1D was changed, to evaluate the print quality. The control method is presented in Table 5.

TABLE 5

| Control method | 1 (Example) | 2 (Comparative Example) | 3 (Comparative Example) |
|---|---|---|---|
| Scope of transportation speed (A) of media Unit of (A) is m/min | 0.1 ≤ (A) | All (regardless of value of (A)) | — |
| | Plasma irradiation | Plasma irradiation | — |
| | 0 ≤ (A) < 0.1 | — | All (regardless of value of (A)) |
| | No plasma irradiation | — | No plasma irradiation |

Control Method 1 presented in Table 5 is a control method according to the example, in which the plasma treatment device is controlled so that the medium 2 is not irradiated with the plasma when the transportation speed of the medium 2 is in the range of 0 m/min to 0.1 m/min, and the medium 2 is irradiated with the plasma when the transportation speed of the medium 2 is greater than 0.1 m/min. Specifically, in Control Method 1, the ink jet printer 1A was controlled as presented in Table 1, the ink jet printer 1B was controlled as presented in Table 2, the ink jet printer 1C was controlled as presented in Table 3, and the ink jet printer 1D was controlled as presented in Table 4.

Control Methods 2 and 3 presented in Table 5 are control methods according to the comparative examples, Control Method 2 is a control method that performs plasma irradiation regardless of the transportation speed of the medium, and Control Method 3 is a control method that does not perform plasma irradiation regardless of the transportation speed of the medium.

Table 6 presents the ratios of the types of gas used in the plasma irradiation. As presented in Table 6, as the types of gas, three kinds were used: argon only, nitrogen only, and mixed gas of nitrogen and oxygen.

TABLE 6

| | Gas 1 | Gas 2 | Gas 3 |
|---|---|---|---|
| Argon | 100 | — | — |
| Nitrogen | — | 100 | 99 |
| Oxygen | — | — | 1 |

As presented in Table 7, printing was performed while the ink jet printers 1A to 1D, Control Methods 1 to 3 thereof, and gas 1 to 3 used in the plasma irradiation were changed, to evaluate the print quality. As the ink jet printers 1A to 1D, a printer in which the plasma treatment device was mounted to PX-H10000 (manufactured by Seiko Epson Corp.) was used.

TABLE 7

| | Example 1 | Example 2 | Example 3 | Example 4 | Example 5 | Example 6 | Comparative Example 1 | Comparative Example 2 |
|---|---|---|---|---|---|---|---|---|
| Control method | 1 | 1 | 1 | 1 | 1 | 1 | 2 | 3 |
| Ink jet printer | 1A | 1A | 1B | 1C | 1D | 1A | 1A | 1A |
| Kind of gas | 1 | 2 | 2 | 2 | 2 | 3 | 2 | 2 |
| Banding unevenness | No | No | No | No | No | No | Yes | No |
| Filling | B | A | A | A | A | A | A | C |

Banding

The determination whether there is color unevenness derived from the banding unevenness (stripe pattern) was visually performed. The banding unevenness refers to a stripe pattern caused by the attachment unevenness of the ink. If the plasma irradiation amounts are not uneven, the wettability of the medium becomes uneven, and as a result, the banding unevenness is generated. The evaluation result is presented in Table 7.

Filling

When the duty 80% printing section was observed by a microscope (200 magnifications), filling of the ink was determined by the ratio in which the base was seen. The evaluation criteria were as follows. The evaluation results were presented in Table 7.

A: Base was not seen at all by ink

B: Portion of base which was not covered with ink and exposed was less than 10%

C: Portion of base which was not covered with ink and exposed was in the range of 10% to less than 20%

As presented in Table 7, in Examples 1 to 6, the banding unevenness was decreased compared with Comparative Example 1 in which printing was performed while the medium was continuously irradiated with the plasma. In addition, in Examples 1 to 6, the filling of the ink was enhanced compared with Comparative Example 2 in which printing was performed while the plasma irradiation was not performed.

In addition, in the examples, if Example 1 was compared with Examples 2 and 6, it was found that the filling of the ink in the case where single gas of $N_2$ or a mixed gas of $N_2$ and $O_2$ was used was enhanced compared with the case where single gas of Ar was used. Accordingly, a radical life span and a bonding method of the functional group were changed by the types of gas, and the level of the surface modification was different. Further, since the single gas of $N_2$ and the mixed gas of $N_2$ and $O_2$ can be manufactured by using a device that extracts nitrogen from the air (by membrane separation), the consumable supplies such as a gas cylinder can be reduced.

The entire disclosure of Japanese Patent Application No. 2014-075792, filed Apr. 1, 2014 is expressly incorporated by reference herein.

What is claimed is:

1. An ink jet printer, comprising:

a transportation mechanism that transports a medium in a first direction;

a plasma irradiation mechanism that irradiates the medium with plasma;

a head mechanism that ejects ink to a portion of the medium irradiated with the plasma and moves in a second direction intersecting the first direction; and a control section that controls whether to irradiate the medium with the plasma by the plasma irradiation mechanism, wherein the control section prohibits the irradiation of the medium with the plasma when a transportation speed of the medium is in a range of 0 m/min to 0.1 m/min, and irradiates the medium with the plasma when the transportation speed of the medium is greater than 0.1 m/min.

2. The ink jet printer according to claim 1, further comprising:

a shutter that can open or close a plasma irradiation opening of the plasma irradiation mechanism, wherein the control section controls the shutter so that the plasma irradiation opening is closed when the transportation speed of the medium is in a range of 0 m/min to 0.1 m/min, and controls the shutter so that the plasma irradiation opening is opened when the transportation speed of the medium is greater than 0.1 m/min.

3. The ink jet printer according to claim 2, wherein gas for generating plasma is supplied to the plasma irradiation mechanism, and the ink jet printer further includes a gas emission mechanism that emits the gas from the plasma irradiation mechanism when the plasma irradiation opening is closed by the shutter.

4. The ink jet printer according to claim 1, further comprising:

a power supply section that supplies electric power to the plasma irradiation mechanism, wherein the control section controls the power supply section so that supplying the electric power to the plasma irradiation mechanism is stopped when the transportation speed of the medium is in a range of 0 m/min to 0.1 m/min, and controls the power supply section so that the electric power is supplied to the plasma irradiation mechanism when the transportation speed of the medium is greater than 0.1 m/min.

5. The ink jet printer according to claim 1, further comprising:

a gas supply mechanism that supplies gas for generating the plasma to the plasma irradiation mechanism; and a gas emission mechanism that emits the gas from the plasma irradiation mechanism, wherein the control section controls the gas emission mechanism so that the gas is emitted from the plasma irradiation mechanism when the transportation speed of the medium is in the range of 0 m/min to 0.1 m/min, and controls the gas supply mechanism so that the gas is supplied to the plasma irradiation mechanism when the transportation speed of the medium is greater than 0.1 m/min.

6. The ink jet printer according to claim 1, wherein the plasma irradiation mechanism emits plasma generated in an electricity discharge portion from a plasma irradiation opening, and the electricity discharge portion of the plasma irradiation mechanism is disposed so as not come into contact with the medium.

7. The ink jet printer according to claim 1, wherein a distance between the plasma irradiation mechanism and the head mechanism is set so that a time after a predetermined position of the medium is irradiated with the plasma by the plasma irradiation mechanism and before the ejection of the ink to the predetermined position is started by the head mechanism is 240 seconds or less.

8. The ink jet printer according to claim 1, wherein the plasma irradiation mechanism is disposed on the head mechanism forwardly in the first direction.

9. A control method of an ink jet printer, that includes a transportation mechanism that transports a medium in a first direction, a plasma irradiation mechanism that irradiates the medium with plasma, and a head mechanism that ejects ink to a portion of the medium irradiated with the plasma and moves in a second direction intersecting the first direction, the method comprising:

prohibiting the irradiation of the medium with the plasma when a transportation speed of the medium is in a range of 0 m/min to 0.1 m/min; and irradiating the medium with the plasma when the transportation speed of the medium is greater than 0.1 m/min.

* * * * *